US010768554B2

(12) United States Patent
Shiran et al.

(10) Patent No.: US 10,768,554 B2
(45) Date of Patent: Sep. 8, 2020

(54) MAINTENANCE PROGRAM FOR LIQUID ELECTRO-PHOTOGRAPHIC PRINTING PROCESSES

(71) Applicant: HP INDIGO B.V., Amstelveen (NL)

(72) Inventors: Eran Shiran, Ness Ziona (IL); Dima Libster, Ness Ziona (IL); Ido Finkelman, Ness Ziona (IL); Raia Slivniak, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/491,480

(22) PCT Filed: Apr. 3, 2017

(86) PCT No.: PCT/EP2017/057840
§ 371 (c)(1),
(2) Date: Sep. 5, 2019

(87) PCT Pub. No.: WO2018/184652
PCT Pub. Date: Oct. 11, 2018

(65) Prior Publication Data

US 2020/0019092 A1 Jan. 16, 2020

(51) Int. Cl.
*G03G 15/16* (2006.01)
*G03G 15/10* (2006.01)

(52) U.S. Cl.
CPC ..... *G03G 15/161* (2013.01); *G03G 15/104* (2013.01); *G03G 15/1675* (2013.01)

(58) Field of Classification Search
CPC .. G03G 15/10; G03G 15/161; G03G 15/1675; G03G 21/06; G03G 21/0094
See application file for complete search history.

(56) References Cited

U.S. PATENT DOCUMENTS

| | | | |
|---|---|---|---|
| 5,821,956 | A | 10/1998 | Kroon et al. |
| 6,181,888 | B1 | 1/2001 | Scheuer et al. |
| 8,967,784 | B2 | 3/2015 | Ram et al. |
| 9,535,359 | B2 | 1/2017 | Sandler et al. |
| 2009/0238592 | A1 | 9/2009 | Yacoub et al. |

FOREIGN PATENT DOCUMENTS

| | | |
|---|---|---|
| WO | WO-2016020015 | 2/2016 |
| WO | WO-2016165736 | 10/2016 |

OTHER PUBLICATIONS

Hauck, Shahram; "Automated CtP Calibration for Offset Printing", 2015, Available at <http://liu.diva-portal.org/smash/get/diva2:821543/FULLTEXT01.pdf >.

*Primary Examiner* — Thomas S Giampaolo, II
(74) *Attorney, Agent, or Firm* — HP Inc. Patent Department

(57) ABSTRACT

A liquid electro-photographic, LEP, printing system, comprising a photo imaging plate, PIP, an intermediate transfer member, ITM, and a control unit. The control unit causes the system to initiate a maintenance program, wherein the maintenance program comprises driving the PIP and the ITM while disabling particle transfer to the PIP and applying a voltage difference between the PIP and surface portions of the ITM.

13 Claims, 3 Drawing Sheets

MAINTENANCE PROGRAM FOR LIQUID ELECTRO-PHOTOGRAPHIC PRINTING PROCESSES

BACKGROUND

Liquid electro-photographic (LEP) printing, sometimes also referred to as liquid electrostatic printing, uses liquid toner to form images on paper, foil, or another print medium. The liquid toner, which is also referred to as electro-ink, includes charged pigmented particles, and a printing process is controlled on the basis of electrophoresis.

BRIEF DESCRIPTION OF THE DRAWINGS

The following detailed description refers to the drawings in which like reference numerals refer to like parts throughout the various views, unless otherwise specified.

DETAILED DESCRIPTION

A LEP printing process may involve selectively charging/discharging areas on a photoconductor, also referred to as photo imaging plate, PIP, to produce a latent electrostatic image. For example, the PIP may be uniformly charged and selectively exposed to light to dissipate the charge accumulated on the exposed areas of the photoconductor in a pixel pattern. The resulting latent image on the photoconductor may then be developed by applying a thin layer of charged particles to the photoconductor.

The charged particles may adhere to the discharged areas on the photoconductor (discharged area development DAD) or to the charged areas on the photoconductor (charged area development CAD), depending on the charge of the particles and the charge accumulated on the PIP surface. The image on the PIP formed by the charged pigmented particles adhering to the PIP may then be transferred to a charged and heated intermediate transfer member, ITM, which fuses the charged particles and transfers the image to the print medium.

Figure 1:
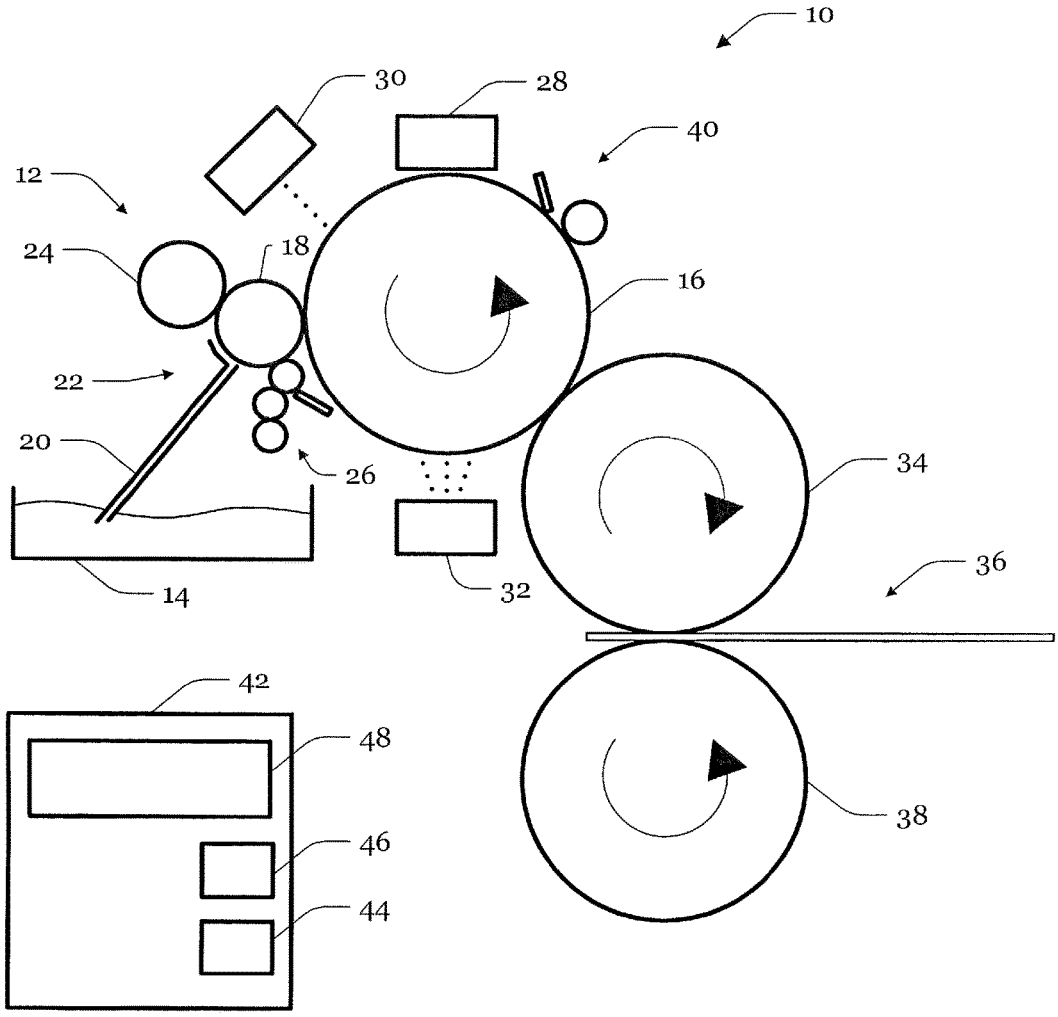
FIG. 1 is a schematic cross-sectional view of an LEP printing system in production mode, according to an example.

FIG. 1 is a schematic cross-sectional view of an LEP printing system 10 in production mode, according to an example. The system 10 may comprise a binary ink developer, BID, assembly 12 which, during operation, feeds charged pigmented particles which may be suspended in a non-conductive carrier liquid, e.g., an iso-paraffinic imaging oil, from an ink reservoir 14 to a PIP 16. The carrier fluid may be a fluid in which polymers, particles, colorant, charge directors and other additives can be dispersed to form a liquid electrostatic ink or electrophotographic ink. While FIG. 1 shows a single BID assembly 12, the system 10 may also comprise a plurality of BID assemblies 12, e.g., one per process color, which in turn feed charged pigmented particles from respective ink reservoirs 14 to the PIP 16.

Figure 3:
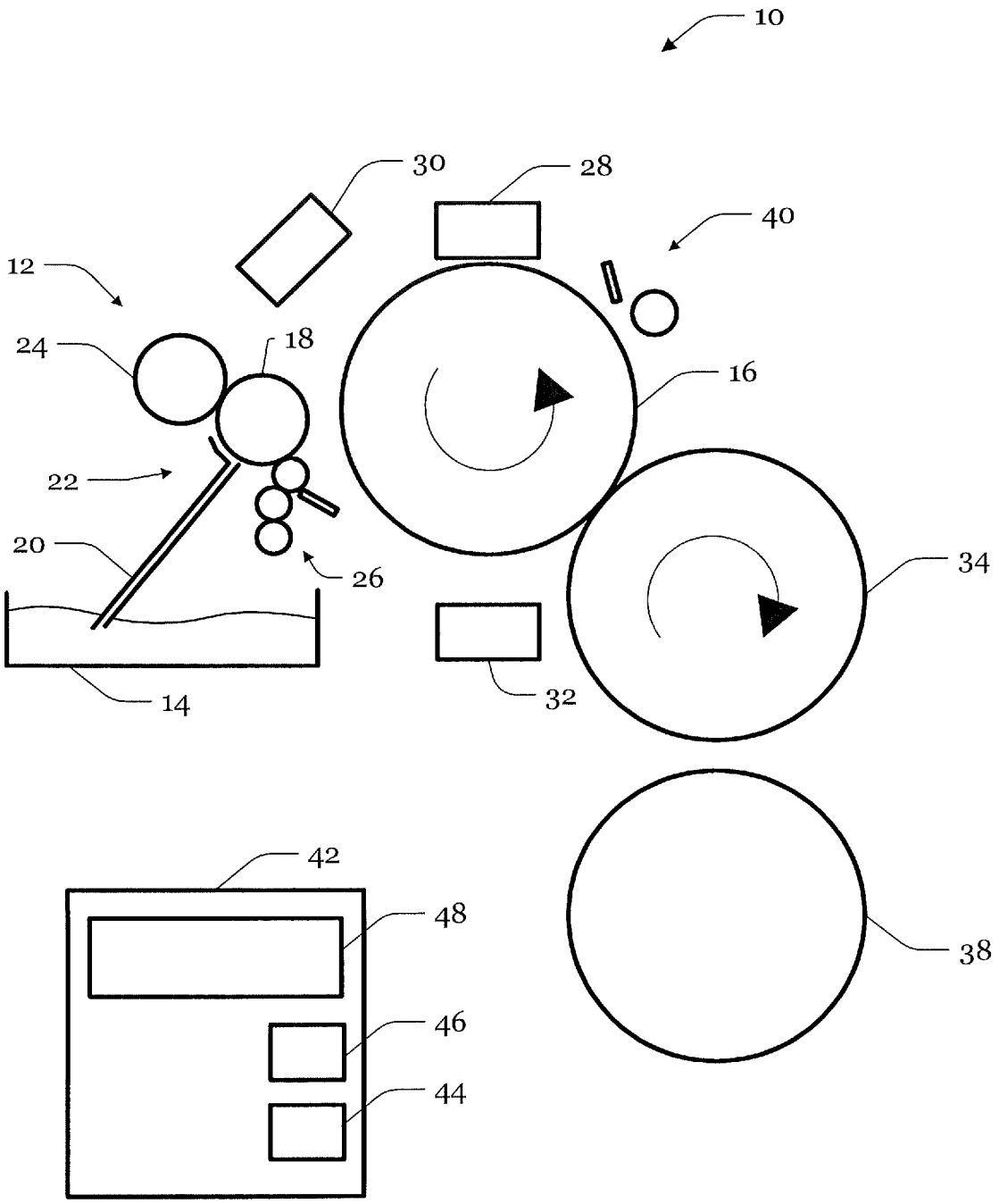
FIG. 3 is a schematic cross-sectional view of the LEP printing system in maintenance mode, according to an example.

When the BID assembly 12 feeds charged pigmented particles to the PIP 16, a developer roller 18 of the BID assembly 12 may be in mechanical contact with the PIP 16. When the BID assembly 12 is to be disengaged from the PIP 16, the developer roller 18 or the whole BID assembly 12 may be moved away from the PIP 16 to a standby position. As shown in FIG. 3, the developer roller 18 may have lost mechanical contact to the PIP 16 when in the standby position. Nevertheless, the developer roller 18 may continue to rotate in the standby position, unless the system 10 is halted.

Continuing with the example shown in FIG. 1, the developer roller 18 may, during operation, receive charged pigmented particles from the ink reservoir 14 via an ink supply path 20. In order to form a dense particle layer on the developer roller 18, the BID assembly 12 may comprise an electrode arrangement 22, including a main electrode and the back electrode, defining the ink supply path 20, wherein ink from the ink supply path 20 passes through a gap between the electrode arrangement 22 and the developer roller 18, at the end of the electrode arrangement 22 facing the developer roller 18. The gap may have a width perpendicular to a flow direction of the ink, wherein the width may span a nominal printing width of the system 10 and substantially correspond to the width of the developer roller 18 (in the direction of its rotational axis).

If the electrode arrangement 22 is charged to a different voltage than the developer roller 18, an electric field may be generated which may be directed in a radial direction towards the developer roller 18. The electric field may draw the charged pigmented particles to the surface of the developer roller 18. Furthermore, the BID assembly 12 may comprise a squeegee roller 24. The squeegee roller 24 may exert mechanical and electrostatic forces onto the charged pigmented particles adhering to the surface of the developer roller 18 when the particles pass the nip between the squeegee roller 24 and the developer roller 18. The squeegee roller 24 may be charged to a different voltage than the developer roller 18 to increase a density of the charged pigmented particles layer on the developer roller 18 by exerting also the electrostatic forces.

After transferring charged pigmented particles onto the surface of the PIP 16, the remaining charged pigmented particles may be removed from the developer roller 18 by a cleaning device 26. The cleaning device 26 may comprise a cleaner roller which may be electrically charged and remove the remaining charged pigmented particles from the developer roller 18. A wiper blade and a sponge roller may be used to remove the charged pigmented particles from the cleaner roller and remix the removed charged pigmented particles with carrier liquid fed from the ink supply path 20.

The PIP 16 may comprise a thin film of photoconductive material wrapped around a cylindrical surface of a rotating drum. In another example, a photoconductive film may be provided on a belt or platen which is movable relative to the BID assembly 12. During operation, electrostatic charge may be uniformly applied to the surface of the photoconductive material, as the photoconductive material passes by a charging station 28. To charge the surface of the photoconductive material, the charging station 28 may, for example, comprise a scorotron, a charge roller, or another charging device.

The uniformly charged surface of the photoconductive material may be guided past a discharging station 30 which is capable of selectively discharging the surface. The discharging station 30 may, for example, selectively expose the surface of the photoconductive material to light. As a result, the charge on the exposed areas may dissipate, which allows to produce a "digital" pattern which may comprise discharged areas adjacent to charged areas. The discharged areas and charged areas may correspond to a pixel pattern of an image to be printed.

For instance, the surface of the photoconductive material may be selectively discharged by a laser enabled to scan over the surface, or another suitable photo imaging device. Hence, the surface of the photoconductive material passing by the discharging station 30 may be divided into charged and discharged areas, wherein a voltage difference between the charged and the discharged areas may, for example, be more than 200 V, more than 400 V, or more than 600 V, or in the range of 200 V to 1000 V.

The latent image on the PIP 16, formed on the surface areas having passed the discharging station 30, may then be developed by transferring charged pigmented particles onto the PIP 16. In the case of DAD, the charged pigmented particles may adhere to the discharged areas of the PIP 16 while being repelled from the charged areas of the PIP 16. In the case of CAD, the charged pigmented particles may adhere to the charged areas of PIP 16 while being repelled from the discharged areas of the PIP 16.

In either case, a pattern of charged pigmented particles in a layer of uniform particle concentration may be selectively formed on areas on a surface of the PIP 16. The residual charge may then be removed from the PIP 16, e.g., by passing the surface of the PIP 16 past a discharging device 32 e.g., an LED lamp, which exposes the PIP 16 surface to light. While the discharging station 30 may selectively discharge the surface of the PIP 16, the discharging device 32 may expose to light the whole surface of the PIP 16 passing by the discharging device 32.

The charged pigmented particles may then be transferred to the ITM 34, wherein the BID 12 is moved away from the PIP 16 during transfer. As shown in FIG. 1, the ITM 34 may, for example, comprise a chargeable blanket wrapped around a rotating drum. In another example, the chargeable blanket may be provided on a belt or platen which is movable relative to the PIP 16. The surface of the blanket may be formed of a layer of silicone rubber comprising, for example, polydimethylsiloxane (PDMS). The blanket may be heated to fuse the charged pigmented particles adhering to the ITM 34. The resulting pigmented layer may be transferred from the ITM 34 to a print medium or print target 36.

The print medium 36, which may be paper, foil, or any other medium, may be delivered to the system 10 as a continuous web, e.g., dispensed from a roll, or as individual sheets and pass through a nip between the ITM 34 and a pressure roller 38. The pressure roller 38, which is also referred to as an impression cylinder (IMP), may press the print medium 36 in the nip against the pigmented layer on the ITM 34 surface, such that the pigmented layer may be cooled down and stick to the print medium 36.

After transferring the pigmented layer onto the ITM 34, ink residue may be removed from surface areas of the PIP 16 which pass by a cleaning station 40. For example, the cleaning station 40 may comprise a cleaning roller and a wiper blade. After passing the cleaning station 40, a uniform electrostatic charge may be re-applied to the PIP 16 surface passing by the charging station 28, to start a new cycle. In each cycle, a process color may be printed by transferring charged pigmented particles of the respective process color onto the PIP 16.

If an image is printed from more than a single process color, multiple pigmented layers having different colors may be transferred one after the other to the ITM 34. The ITM 34 may collect the pigmented layers and transfer the full image onto the print medium 36, or the color layers may be transferred one after the other onto the print medium 36. In the first case, the pressure roller 38 may be engaged with the ITM 34 after the pigmented layers are collected on the ITM 34.

The operation of the system 10 may be controlled by a control unit 42. The control unit 42 may comprise machine-readable instructions stored on a machine-readable medium 44 and a processor 46. The processor 46 may be communicatively connected to a controller which controls a movement of the PIP 16 and the ITM 34. For instance, the controller may control an electric motor mechanically connected to a drive shaft of the PIP 16 and/or the ITM 34 to rotate the PIP 16 and the ITM 34 at the same surface speed.

The processor 46 may also be communicatively connected to a controller which controls a movement of the pressure roller 38. For example, the controller may control an electric motor mechanically connected to a drive shaft of the pressure roller 38 to rotate the pressure roller 38 at a same surface speed as the ITM 34. The controller may also control a linear drive which allows engaging/disengaging the pressure roller 38 and the ITM 34.

The processor 46 may also be communicatively connected to a controller which controls the operation of the BID assembly 12. For instance, the controller may control an electric motor mechanically connected to a drive shaft of the developer roller 18 to rotate the developer roller 18 at a same surface speed as the PIP 16. The controller may also control a linear drive which allows engaging/disengaging the developer roller 18 and the PIP 16.

The control unit 42 may also comprise a human-machine interface 48 allowing a user to start and halt the system 10, as well as manually initiating or scheduling a maintenance program during which the system 10 operates in a maintenance mode, wherein the scheduled maintenance program may be automatically initiated if a specific condition is met. For example, the condition may effect that the maintenance program is to be initiated after a predefined number of printed images, or if a maintenance score meets a threshold.

The maintenance score may be a function of the number of printed images as well as other factors derived from analyzing the printed images. For example, printing an image which is evenly black may allow for lowering a maintenance frequency as compared to an image having multiple colors and small text, both, in terms of having to cope with uneven wear due to printing an uneven image, as well as meeting a desired print quality.

The control unit 42 may also comprise a monitoring interface which allows feeding the control unit 42 with parameters or even pictures of printed images. The control unit 42 may analyze the provided data and strive to detect print quality issues. If print quality issues are detected, a maintenance program may be initiated. For instance, the control unit may select a maintenance program to mitigate a detected print quality defect.

As some print quality defects may be more easily detected in some images than others, the control unit 42 may also print a (single) test image or a small number (e.g., less than 100 or less than 10) of different test images. The test image may be used to verify a print defect detected in a printed image of a regular printing task, or to reveal up-coming print defects before they become detectable in printed images of a regular printing task, which would otherwise possibly have to be discarded.

Thus, in addition to controlling the production mode, the control unit 42 may schedule maintenance operations which are to be carried out in the maintenance mode, wherein the maintenance operations may be directed at avoiding or mitigating print defects as discussed in more detail with reference to FIGS. 2 and 3.

Figure 2:
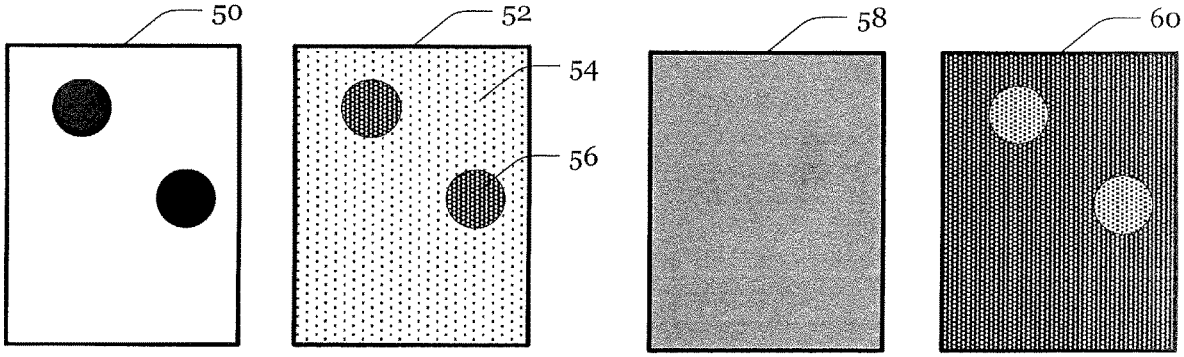
FIG. 2 illustrates a printing phenomenon which is to be mitigated by switching the system from production mode to maintenance mode.

FIG. 2 illustrates circumstances under which a print defect may come up, as well as the printing defect itself. FIG. 2 shows an image 50 to be printed as well as the printed image 52. Notably, the printed image 52 comprises an area 54 of small (or even zero) pigment density and an area 56 of high pigment density. In this regard, it is to be noted that the area 56 of high pigment density may relate to pigments of a same color as well as pigments of different colors.

If, after repeated printing cycles of the same image 50 on the same area of the blanket, a new printing task with another image is printed such as, for example, a gray image 58, a negative dot gain (NDG) "ghost memory" of the previously printed image 52 may be observed in the printed images 60 of the new printing task. A NDG "ghost memory" may manifest itself in subsequent printings by producing ghost images with decreased optical density or dot size and brighter visual appearance, as compared to the background, depending on the image 50 which caused the NDG "ghost memory".

Without being bound to any theory, a possible explanation of the generation of the NDG "ghost memory" might be that, after a large number of printing cycles of the same image, hidden charged and uncharged spots remain below the surface of the ITM, or there is some other physical or chemical effect within the ITM surface layer caused by the preceding printing cycles. The repetitive printing of the same image 50 also may affect the transfer of charged pigmented particles between the PIP 16 and the ITM 34, e.g because of absorption of carrier liquid by the blanket, which may be uneven over the blanket surface. For instance, the printed image 52 having an area 54 of small (or even zero) pigment density and an area 56 of high pigment density may lead to an uneven swelling of the blanket.

To overcome or mitigate the NDG "ghost memory" effect and related printing defects, the control unit 42 may initiate a maintenance program. The maintenance program may comprise driving or moving the PIP 16 and the ITM 34 while applying a voltage difference between the PIP 16 and surface portions of the ITM 34, as illustrated in FIG. 3. During maintenance, selective discharge of the PIP 16 may be disabled or halted. The maintenance program may also comprise disabling or halting particle transfer to the PIP 16. Hence, the BID assembly 12 may be disengaged from the PIP 16. Further, the cleaning station 40 may be disengaged from the PIP 16. Similarly, the pressure roller 38 may be disengaged from the ITM 34. When the pressure roller 38 is disengaged from the ITM 34, the pressure roller 38 may be halted. Also, delivering the print medium 36 to the system 10 may be halted.

The voltage difference between the PIP 16 and the blanket of the ITM 34 may be larger than a nominal operation voltage difference. For instance, the voltage difference between the PIP 16 and the blanket of the ITM 34 may be about 3 to about 4 times a nominal operation voltage difference. For example, the voltage difference may be above 1950V with a voltage of about −1000 V to about −1200 V being applied to the PIP 16 and a bias voltage of about +950 V being applied to the blanket of the ITM 34. These values, which are indicated for illustration purposes, are assumed for a configuration where, during printing, the PIP 16 is discharged after moving away from the BID assembly 12 and before contacting the ITM 34 and is at a low voltage, e.g. below 60 V, or close to zero voltage, and a nominal bias voltage of the ITM 34 is about +550 V, resulting in a nominal printing operation voltage difference of about 550 V to 600 V, for example.

Accordingly, the charging station 28 may be operated at a higher charging level as compared to a nominal charging level applied during productive printing, i.e., when the system 10 is in production mode as described with reference to FIG. 1, while the operation of the discharging station 30 and the discharging device 32 may be disabled or halted. Also, the bias voltage of the blanket of the ITM 34 may be increased as compared to a nominal bias voltage applied during productive printing. Hence, the voltage difference between the PIP 16 and the blanket of the ITM 34 may be higher during maintenance mode, than any voltage differences between surface portions of the PIP 16 and the blanket of the ITM 34 during production mode. For example, the PIP 16 and the ITM 34 may be charged to a maximum admissible voltage value.

Applying the high voltage to the blanket of the ITM 34 may reduce or eliminate the NDG "ghost memory" effect and related printing defects. The high voltage may be applied during a null cycle, e.g. at a substantially normal process speed of the ITM 34 without image transfer.

The maintenance program may be carried out for a predetermined time, e.g., about 0.5 to 2.5 or 0.5 to 3 minutes, or for about 1 minute, while the exact time amount may vary and be chosen on the basis of such factors as severity of a printing defect and/or blanket age. The maintenance program may further comprise a predetermined number of full cycles (rotations) of the PIP 16 and the ITM 34. The maintenance program may be repeated in regular or irregular intervals. For example, the maintenance program may be initiated every fixed number of prints, such as after every 1000 prints or integer multiples thereof, such as 2000 prints, 3000 prints, 4000 prints, etc. or every 10,000 prints, 11,000 prints, 12,000 prints, etc. The maintenance program may be initiated as a matter of precaution before a printing defect is observed or after detecting that a printing defect occurred. A printing defect can be detected during a productive printing operation or by printing a test image.

During the maintenance program, the surface speed of the PIP 16 and the ITM 34 may be substantially equal to a nominal printing speed. Yet, the surface speed of the PIP 16 and the ITM 34 may also be substantially lower than a nominal printing speed. For instance, the surface speed of the PIP 16 and the ITM 34 may be below half or below one tenth of the nominal printing speed.

Also, a test image or a production image may be printed at the end of the maintenance program and the maintenance program may be resumed based on an analysis of said image. For example, the maintenance program may be resumed if the printing defect persists, or if the printing quality is found to be not yet acceptable. Also, a voltage difference between the PIP 16 and the blanket of the ITM 34 may be increased between successive initiations of the maintenance program, or on demand, if the maintenance program is resumed (which may be performed in case that a printing defect persists).

The voltage difference between the PIP 16 and the blanket of the ITM 34 may be kept below a voltage threshold at which any chemical, electrical, or physical effect or a combination of such effects may adversely affect blanket characteristics of the ITM 34.

In yet another example, the discharging station 30 may be operated to establish a latent image which is substantially inverse to the latent image that caused the printing defect. Accordingly, the higher voltage difference may be applied to the surface portions of the blanket which exhibit the NDG "ghost memory" effect. In this case, the transfer of charged particles to the PIP 16 may be resumed and the inverse image may be printed. The printed inverse images may be classified as "maintenance prints" and exhibit a print quality below a print quality achieved during normal production mode, if the voltage difference between the PIP 16 and the blanket of the ITM 34 is increased above the nominal voltage difference.

Figure 4:
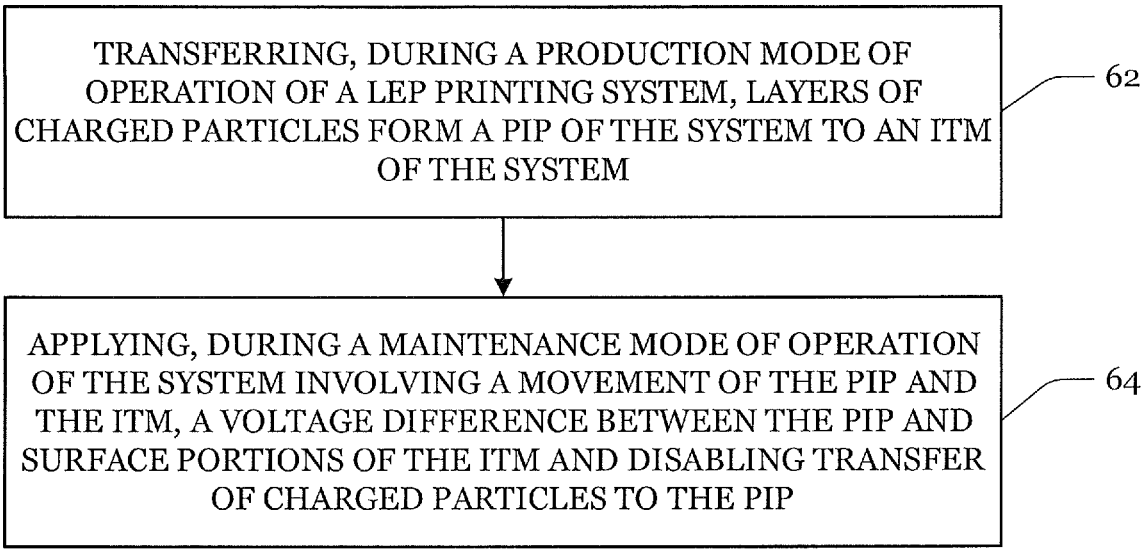
FIG. 4 is a flow-chart of a process of operating the LEP printing system, according to an example.

FIG. 4 is a flow-chart of a process of operating the LEP printing system 10, according to an example. The process comprises at 62 by transferring, during the production mode, layers of charged pigmented particles form the PIP 16 to the ITM 34. At 64, the process applies, during maintenance mode, a voltage difference between the PIP 16 and the blanket of the ITM 34.

Figure 5:
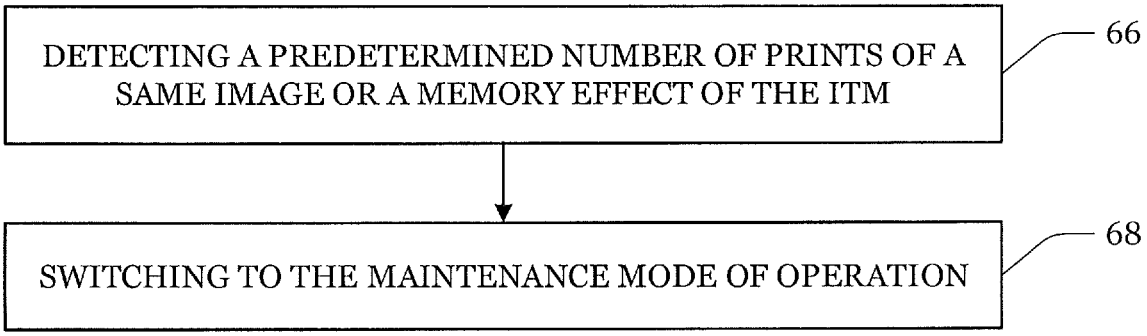
FIG. 5 is a flow-chart of a process of determining a condition upon which a LEP printing system is to switch from production mode to maintenance mode, according to an example.

FIG. 5 is a flow-chart of a process of determining the condition upon which the system 10 is to switch from production mode to maintenance mode, according to an example. At 66, the process comprises detecting a predetermined number of prints of a same image or a memory effect of the blanket. At 68, the process switches to the maintenance mode.

The invention claimed is:

1. A liquid electro-photographic, LEP, printing system, comprising:

a photo imaging plate, PIP;

an intermediate transfer member, ITM; and a control unit, the control unit to cause the system to:

initiate a maintenance program, wherein the maintenance program comprises driving the PIP and the ITM while disabling particle transfer to the PIP and while applying a voltage difference between the PIP and surface portions of the ITM which is larger than a nominal operation voltage difference.

2. The system of claim 1, wherein the maintenance program comprises applying a voltage difference between the PIP and surface portions of the ITM which is about 3 to about 4 times a nominal operation voltage difference.

3. The system of claim 1, wherein the maintenance program the control unit to cause the system to initiate the maintenance program after a predetermined number of prints of a same image.

4. The system of claim 1, wherein the maintenance program comprises driving the PIP and the ITM to rotate relative to each other for a predetermined time, or for about 0.5 to 3 minutes, or for about 1 minute.

5. A machine-readable medium, comprising machine-readable instructions which when carried out by a control unit of a liquid electro-photographic, LEP, printing system, cause the system to:

halt a selective discharge of a photo imaging plate, PIP, of the system;

halt a transfer of charged particles onto the PIP; and drive the PIP and an intermediate transfer member, ITM, of the system while:

applying a voltage difference between the PIP and surface portions of the ITM which is larger than a nominal operation voltage difference, and halting the selective discharge and the transfer of charged particles.

6. The machine-readable medium of claim 5, comprising persistently stored machine readable instructions which when carried out by a control unit of a LEP printing system cause the system to:

monitor a number of prints of a same image or a memory effect of the ITM; and increase a voltage difference between the PIP and the surface portions of the ITM, if the number or the memory effect is above a threshold.

7. A method, comprising:

transferring, during a production mode of operation of a liquid electro-photographic, LEP, printing system, layers of charged particles form a photo imaging plate, PIP, of the system to an intermediate transfer member, ITM, of the system; and applying, during a maintenance mode of operation of the system involving a movement of the PIP and the ITM, a voltage difference between the PIP and surface portions of the ITM which is larger than a nominal operation voltage difference, and disabling transfer of charged particles to the PIP.

8. The method of claim 7, further comprising:

detecting a predetermined number of prints of a same image or a memory effect of the ITM; and switching to the maintenance mode of operation.

9. The method of claim 7, wherein the movement of the PIP and the ITM during the maintenance mode of operation comprises a predetermined number of full cycles of the PIP and the ITM, or wherein the movement of the PIP and the ITM during the maintenance mode of operation is performed for a predetermined time duration, or is performed for about 0.5 to 2.5 minutes, or for about 1 minute.

10. The method of claim 7, wherein the voltage difference between the PIP and surface portions of the ITM is about 3 to about 4 times a nominal operation voltage difference.

11. The method of claim 7, wherein a voltage of about −1000 V to about −1200 V is applied to the PIP and a voltage of about +950 V is applied to the ITM.

12. The method of claim 7, wherein the voltage difference between the PIP and surface portions of the ITM during the maintenance mode of operation is higher than any voltage differences between the PIP and surface portions of the ITM during the production mode of operation.

13. The method of claim 7, wherein the surface portions of the ITM correspond to portions exhibiting a negative memory effect of the ITM.

* * * * *